US008377522B2

(12) United States Patent
Desrousseaux et al.

(10) Patent No.: US 8,377,522 B2
(45) Date of Patent: Feb. 19, 2013

(54) USE OF ORGANOCLAYS IN INKJET RECEIVER LAYER TO PREVENT THE OZONE FADE OF PRINT

(75) Inventors: Stephanie V. Desrousseaux, Cambridge (GB); Olivier J. Poncelet, Chalon-sur-Saone (FR); Gerard A. Friour, Chalon sur Saone (FR)

(73) Assignee: Eastman Kodak Company, Rochester, NY (US)

( * ) Notice: Subject to any disclaimer, the term of this patent is extended or adjusted under 35 U.S.C. 154(b) by 190 days.

(21) Appl. No.: 12/517,359

(22) PCT Filed: Dec. 19, 2007

(86) PCT No.: PCT/GB2007/004881

§ 371 (c)(1), (2), (4) Date: Jun. 3, 2009

(87) PCT Pub. No.: WO2008/075041

PCT Pub. Date: Jun. 26, 2008

(65) Prior Publication Data

US 2010/0003428 A1 Jan. 7, 2010

(30) Foreign Application Priority Data

Dec. 21, 2006 (GB) ..... 0625592.1

(51) Int. Cl.
*B41M 5/40* (2006.01)

(52) U.S. Cl. ..... 428/32.24; 428/32.25; 428/32.3; 428/32.34; 428/32.36; 428/32.38; 347/105

(58) Field of Classification Search ..... 428/32.24, 428/32.25, 32.3, 32.34, 32.36, 32.38; 347/105
See application file for complete search history.

(56) References Cited

U.S. PATENT DOCUMENTS

| | | | | |
|---|---|---|---|---|
| 5,342,876 | A | 8/1994 | Abe et al. | |
| 5,919,559 | A | 7/1999 | Nakano et al. | |
| 6,492,005 | B1 * | 12/2002 | Ohbayashi et al. | 428/32.29 |
| 7,132,165 | B2 | 11/2006 | Pinnavaia et al. | |
| 2005/0158486 | A1 | 7/2005 | Kapusniak et al. | |
| 2005/0253916 | A1 | 11/2005 | Poncelet et al. | |
| 2006/0078696 | A1 * | 4/2006 | Furholz et al. | 428/32.34 |
| 2006/0083870 | A1 | 4/2006 | Chen | |

FOREIGN PATENT DOCUMENTS

| | | |
|---|---|---|
| EP | 0 976 571 | 2/2000 |
| EP | 1 162 076 | 9/2002 |
| JP | 59-103789 | 6/1984 |
| JP | 2003-080832 | 3/2003 |
| JP | 2005125515 | 5/2005 |
| WO | 2004/009494 | 1/2004 |
| WO | 2004/039724 | 5/2004 |
| WO | 2005/009747 | 2/2005 |

* cited by examiner

*Primary Examiner* — Betelhem Shewareged
(74) *Attorney, Agent, or Firm* — Andrew J. Anderson

(57) ABSTRACT

An inkjet receiver is described which comprises a support and one or more layer coated thereon, at least one layer of which comprises one or more metal organosilicate polymer particulate materials. The metal organosilicate polymer particulate materials are obtainable by contacting a metal salt with a silicon-containing compound having an organic substituent in an organic solvent, wherein either the silicon-containing compound contains a basic group and/or the reaction is conducted in the presence of a base, wherein the metal is selected from one or more of aluminum, magnesium strontium, calcium or zinc and the silicon-containing compound comprises hydrolyzable and non-hydrolyzable substituents such as to form a metal organosilicate polymer particulate material therefrom. The described inkjet receiver is useful for forming images by inkjet printing having excellent color fastness over time.

20 Claims, No Drawings

USE OF ORGANOCLAYS IN INKJET RECEIVER LAYER TO PREVENT THE OZONE FADE OF PRINT

FIELD OF THE INVENTION

The invention relates to an inkjet receiver or recording element comprising polymeric metal organic silicate particles. More specifically the invention relates to an inkjet receiver comprising such a metal organosilicate polymer particulate material and demonstrating excellent printed colour density, image quality and resistance to fading from exposure to ozone.

BACKGROUND OF THE INVENTION

Digital photography has been growing rapidly for several years and the general public now has access to efficient and reasonably priced digital cameras. Therefore people are seeking to be able to produce photographic prints from a simple computer and its printer with the best possible quality.

Many printers, especially those linked to personal office automation, use the inkjet printing technique. There are two major families of inkjet printing techniques: continuous jet and drop-on-demand.

Continuous jet is the simpler system. Pressurized ink (typically $3.10^5$ Pa) is forced through one or more nozzles so that the ink forms a flow of droplets. Regular pressure pulses ensure regular sizes and spaces between droplets and can be generated using, for example, a piezoelectric crystal with high frequency (up to 1 MHz) alternating current (AC) power supply. So that a message can be printed using a single nozzle, every drop must be individually controlled and directed. Electrostatic energy is used for this: an electrode is placed around the inkjet at the place where drops form. The jet is charged by induction and every drop henceforth carries a charge whose value depends on the applied voltage. The drops then pass between two deflecting plates charged with the opposite sign and then follow a given direction, the amplitude of the movement being proportional to the charge carried by each of them. To prevent other drops from reaching the paper they are left uncharged, so instead of going to the support they continue their path without being deflected and go directly into a container. The ink is then filtered and can be reused. Alternatively, deflection of ink droplets can be effected by selectively controlling the size of the drop to allow them to be sorted by selective deflection using a stream of air.

The other category of inkjet printing is drop-on-demand (DOD). This is the most commonly used inkjet printing method in the home and office environment. With this method the pressure in the ink cartridge is not maintained constant but is applied when a character has to be formed. In one widespread system there is a row of open nozzles, each of them being activated with a piezoelectric crystal. The ink contained in the head is given a pulse: the piezo element contracts with an electric voltage which causes a decrease of volume, leading to the expulsion of the drop by the nozzle. When the element resumes its initial shape, it pumps in the reservoir the ink necessary for new printings. The row of nozzles is thus used to generate a column matrix so that no deflection of the drop is necessary. One variation of this system consists in replacing the piezoelectric crystals by small heating elements behind each nozzle. The drops are ejected following the forming of bubbles of solvent vapour. The volume increase enables the expulsion of the drop. Finally, there is a pulsed inkjet system in which the ink is solid at ambient temperature. The printhead thus has to be heated so that the ink liquefies and can print. This enables rapid drying on a wider range of products than conventional systems.

There now exist new "inkjet" printers capable of producing photographic images of excellent quality. However, they cannot supply good proofs if inferior quality printing paper is used. The choice of printing paper is fundamental for the quality of the obtained image. The printing paper should combine the following properties: high quality printed image, rapid drying after printing, good dye keeping over time, smooth appearance and high gloss.

In general, the printing paper comprises a support coated with one or more layers according to the properties required. It is possible, for example, to apply on a support a primary attachment layer, an absorbent layer, an ink dye-fixing layer, and a protective layer or surface layer to provide the glossiness of the recording element. A single layer may provide more than one of these functions. The absorbent layer absorbs the liquid part of the water-based ink composition after creation of the image. Elimination of the liquid reduces the risk of ink migration at the surface. The ink dye-fixing layer prevents any dye loss into the fibres of the paper base to obtain good colour saturation, whilst preventing excess ink that would encourage the increase in size of the printing dots and reduce the image quality. The absorbent layer and dye-fixing layer can also constitute a single ink-receiving layer ensuring both functions. The protective layer is designed to ensure protection against fingerprints and the pressure marks of the printer feed rollers. The ink-receiving layer comprises a binder, a receiving agent and various additives. The purpose of the receiving agent is to fix the dyes in the printing paper. The best-known inorganic receivers are fumed alumina, fumed silica, colloidal silica and boehmite. For example, EP-A-0 976 571 and EP-A-1 162 076 describe recording elements for inkjet printing in which the ink-receiving layer contains, as inorganic receivers, Ludox™ CL (colloidal silica) marketed by Grace Corporation, or Dispal™ (colloidal boehmite), marketed by Sasol. However, printing paper comprising an ink-receiving layer containing such inorganic receivers can have poor image stability over time, which is demonstrated by a loss of colour density.

To meet the new requirements of the market in terms of photographic quality, printing speed and colour stability, it is necessary to be able to offer a new inkjet recording element having the properties as defined above, more particularly good dye-keeping properties, whilst keeping instant dryness.

Naito et al. in published application JP 59-103789 disclose a plain paper for inkjet recording in which the sizing agent or surface-coating agent comprises a filler including a clay mineral modified by an organic substance. Plain paper does not provide a photographic quality print.

Abe et al. in U.S. Pat. No. 5,342,876 describe inkjet recording papers coated with aluminium, zinc and magnesium phyllosilicates in a poly(vinyl alcohol) binder, providing improved resistance to fading of image dyes exposed to UV light. These materials are made in the presence of 30% polyacrylamide with respect to silica, but do not include any organic moiety covalently bound to silicon.

Nakano et al. in U.S. Pat. No. 5,919,559 describe an inkjet recording sheet comprising particles of a layered silicate modified with an organic treating agent such as a poly(oxyethylene)trialkylammonium chloride, the preparation of which is described in JP 06-287014. Here an alkylammonium ion is intercalated between the layers, but does not form a covalent bond with silicon. No improvement in resistance to dye fade is demonstrated.

Iguchi et al. in JP 2003-080832 disclose a coating agent for an inkjet recording sheet comprising silsesquioxane particles represented by the structural unit $RSiO_{(3/2)}$. The particles do not contain a metal and no improvement of dye-fade resistance is disclosed.

Kapusniak et al. in US 2005/0158486 disclose an inkjet recording element comprising particles of aluminosilicate for improved high humidity keeping. The particles do not contain an organic moiety and no mention is made of improved resistance to ozone fade. The recording element is swellable, not porous.

Chen in US 2006/0083870 discloses a porous ink-receiving layer comprising amine-functionalized particulates, which may be clays. The amine-functionalized particles are intended to covalently couple with epoxy-modified particles to provide a binding function and reduce cracking. No disclosure of improved resistance to ozone fade is made.

Bringley et al. in publication WO 2005/009747 describe porous inkjet media containing core/shell particles, wherein the shell of the particles is an oligomeric or polymeric aluminosilicate complex or aluminosilicate particulate and the core is organic or inorganic. Core materials having a negative surface charge, such as silica, are preferred. The resistance to fading of image dyes printed on the medium is improved, compared with standard particles of silica or alumina. The particles are not organically modified.

Pinnavia et al. in U.S. Pat. No. 7,132,165 disclose novel lamellar mesoporous silica compositions which contain functional inorganic elements and organic functional groups, prepared using gemini amine surfactants as template or structure-directing agents. It is stated that such a material could find a catalytic application but there is no disclosure of use in an inkjet-related application.

WO 2004/039724 discloses an aluminosilicate polymer obtained by treating an unmodified mixed aluminium and silicon alkoxide with an aqueous alkali, stirring the resulting mixture for sufficient time for a polymer to form and eliminating the by-products. The mixed aluminium and silicon alkoxide is preferably formed by reaction of, for example, aluminium chloride with a silicon alkoxide, such as silicon tetraethoxide.

Analogously WO 2004/009494 discloses a hybrid aluminosilicate polymer obtained by treating a mixed aluminium and silicon alkoxide, the silicon alkoxide having both hydrolyzable and non-hydrolyzable substituents, with an aqueous alkali, stirring the resulting mixture for sufficient time for a polymer to form and eliminating the by-products. The mixed aluminium and silicon alkoxide is preferably formed by reaction of, for example, aluminium chloride with an unmodified silicon alkoxide, such as tetraethoxysilane, and a modified silicon alkoxide, such as methyl triethoxysilane.

In both the above specifications, the preparation of the aluminosilicate requires the molar concentration of aluminium to be less than 0.3, the molar ratio of aluminium to silicate to be from 1 to 3.6 and the alkali to aluminium molar ratio to be from 2.3 to 3. The reactions are conducted in the presence of silanol groups, such as silica beads. Aluminosilicate polymers made according to these methods find particular utility as components of ink-receiving layer of inkjet receiver having improved dye-keeping properties and gloss.

There is a continuing need for an inkjet receiver that has improved colour stability on printing and improved keeping to enable longevity of photographic prints and colour documents prepared via inkjet printing.

SUMMARY OF THE INVENTION

According to the present invention, there is provided an inkjet receiver comprising a support and one or more layers coated thereon, at least one layer of which comprises one or more metal organosilicate polymer particulate material(s) and a binder, the metal organosilicate polymer particulate material being obtainable by contacting a metal salt with a silicon-containing compound in an organic solvent, wherein either the silicon-containing compound contains a basic group and/or the reaction is conducted in the presence of a base, wherein the metal is selected from one or more of aluminium, magnesium, strontium, calcium or zinc and the silicon-containing compound comprises hydrolyzable and non-hydrolyzable substituents; and collecting the metal organosilicate polymer particulate material obtained therefrom.

According to a second aspect of the invention, there is provided an inkjet receiver comprising a support and one or more layers coated thereon, at least one layer of which comprises one or more metal organosilicate polymer particulate material(s) and a binder, the metal organosilicate polymer particulate material comprising particles having a first metal in coordination with an organosilicate, wherein the first metal is selected from one or more of aluminium, magnesium, strontium, calcium and zinc, the organosilicate comprises a silicon-containing compound having an organic substituent and the metal:silicon ratio is in the range from 3:2 to 1:2, preferably 1:1 to 1:2.

According to a third aspect of the invention, there is provided a method of preparing an inkjet receiver, the method comprising coating a formulation onto a support and drying the coated support to form a receiving layer on the support, the formulation comprising a solution or dispersion of an inorganic particulate material, comprising one or more metal organosilicate polymer particulate material(s) as defined above and a binder.

According to a fourth aspect of the invention, there is provided a method of printing comprising the steps of providing an inkjet printer capable of responding to digital data signals; providing the printer with ink; providing the printer with an inkjet receiver as defined above; and causing a set of digital data signals corresponding to a desired printed image to be sent to the printer.

According to a fifth aspect of the invention, there is provided a printed receiver comprising an image printed onto a receiver as defined above by the above-defined method.

ADVANTAGEOUS EFFECT OF THE INVENTION

The inkjet recording element according to the present invention has improved printed image stability and improved keeping over time, whilst enabling the rapid uptake of ink and rapid dry-time associated with a porous receiver. As compared with inkjet recording elements available on the market, a significant improvement in keeping properties can be demonstrated.

Whilst providing these benefits, the inkjet receiver or recording element of the invention is formulated in a way that is amenable to scaled-up manufacturing and can provide the benefits in a cost-efficient manner.

Advantageously, an inkjet receiver of the invention is adaptable during manufacture for use either as a dye-based ink receiver or as a universal receiver, i.e. a dye- or pigment-based ink receiver.

DETAILED DESCRIPTION OF THE INVENTION

The inkjet receiver or inkjet recording element according to the present invention comprises a support and at least one layer coated thereon for receiving ink according to a desired image, the inkjet receiver benefiting from improved keeping properties from the formulation of the ink-receiving and image receiving layers as described below.

The support may be any suitable support and may be selected according to the desired use and may be, for example, a transparent or opaque thermoplastic film, especially a polyester base film such as polyethylene terephthalate or polymethylmethacrylate; cellulose derivatives, such as cellulose ester, cellulose triacetate, cellulose diacetate; polyacrylates; polyimides; polyamides; polycarbonates; polystyrenes; polyolefines; polysulfones; polyetherimides; vinyl polymers such as polyvinyl chloride; and their mixtures. Alternatively, the support may be paper, one or preferably both sides of which may be coated with a polyethylene layer. When the support comprising the paper pulp is coated on both sides with polyethylene, it is commonly referred to as resin-coated paper (RC Paper). The side of the support that is used can be coated with a base layer, for example a very thin layer of gelatin or another composition, to ensure the adhesion of the first layer on the support.

The support used may be of any suitable thickness, such as, for example from 50 to 500 μm or preferably from 75 to 300 μm. Antioxidants, antistatic agents, plasticizers or other known additives may be incorporated into the support, if desired.

The inkjet receiver has one or more layers coated on to the support, at least one layer of which comprises at least one metal organosilicate polymer particulate material, the inclusion of which is capable of eliciting the keeping benefits described herein. Each such layer comprises the metal organosilicate polymer particulate material and a binder and optional further components, such as a second metal organosilicate polymer particulate material or other components as will be described in more detail below.

Thus the inkjet receiver according to the invention may comprise one layer or may comprise multiple layers, one or more of which comprises the metal organosilicate polymer particulate material and the binder. Where more than one layer is coated onto the support, the inkjet receiver (or inkjet recording element) may be described as having an ink-receiving pack, which comprises the ink-receiving layers including image-receiving layers, being those ink-receiving layers in which the dye (or pigment) image is actually formed. The inkjet receiver may comprise one or more base layers between the ink-receiving pack and the support and a top layer for protecting the ink-receiving pack.

The ink-receiving pack comprises, for example, one or more image-receiving layers (typically one image-receiving layer) and further layers which are involved in the ink-receiving process, such as those intended to absorb the carrier fluid of the ink or provide capacity (e.g. a sump) or to increase the draw or rate of uptake of ink from the surface of the receiver. Typically, the ink-receiving pack comprises the image-receiving layer(s) and the liquid-absorbing layers and any intermediate layers.

The binder used in the metal organosilicate polymer particulate material-containing layer(s) of the inkjet receiver may be any suitable material for binding metal organosilicate polymer particulate material in an inkjet receiver layer. Suitable such binders may be selected, for example, from one or more of naturally occurring hydrophilic colloids and gums such as gelatin, albumin, guar, xantham, acacia and chitosan and their derivatives, functionalized proteins, functionalised gums and starches, cellulose ethers and their derivatives, such as hydroxyethyl cellulose, hydroxypropyl cellulose and carboxymethyl cellulose, latex polymers such as styrene butadiene latex and styrene acrylate latex, polyvinyl oxazoline and polyvinyl methyloxazoline, polyoxides, polyethers, poly (ethylene imine), poly(acrylic acid), poly(methacrylic acid), n-vinyl amides including polyacrylamide and polyvinyl pyrrolidone, polyethylene oxide and polyvinyl alcohol, its derivatives and copolymers. Preferably, the binder is at least one hydro-soluble binder, which is preferably a gelatin or polyvinyl alcohol. The binder may be a gelatin, such as that conventionally used in the photographic field. Such a gelatin is described in Research Disclosure, September 1994, No. 36544, part IIA. *Research Disclosure* is a publication of Kenneth Mason Publications Ltd., Dudley House, 12 North Street, Emsworth, Hampshire PO107DQ, United Kingdom. The gelatin can be obtained from SKW, France, and the polyvinyl alcohol from Nippon Gohsei or Alfa Aesar. Preferably, the binder is a polyvinyl alcohol.

Any other layers of the inkjet receiver may also comprise a binder as defined above.

As described above, the inkjet receiver according to the invention comprises in at least one layer thereof, preferably in at least one layer of the ink-receiving pack, more preferably in an ink-receiving layer and optionally in an image-receiving or -recording layer, one or more metal organosilicate polymer particulate materials, together with a binder. The metal organosilicate polymer particulate material may be described in terms of the method by which it is produced, since the structure and properties of such materials may sometimes be difficult to ascertain and characterize by other means and may depend to some degree upon the method of production. An alternative (or additional) definition of the metal organosilicate polymer particulate material(s) used is also described in terms of the relative ratio of the components of the metal organosilicate polymer particulate material.

In one aspect mentioned above, the inkjet receiver is characterized by the metal organosilicate polymer particulate material being obtainable by contacting a metal salt with a silicon-containing compound in an organic solvent, wherein either the silicon-containing compound contains a basic group and/or the reaction is conducted in the presence of a base, wherein the metal is selected from one or more of aluminium, magnesium, strontium, calcium or zinc and the silicon-containing compound comprises hydrolyzable and non-hydrolyzable substituents and collecting the resulting metal organosilicate polymer particulate material.

The metal organosilicate polymer particles are formed by reacting a metal salt or a mixture of metal salts with one or more silicon-containing compounds as defined above, especially one or more silicon alkoxides.

The metal salt or mixed metal salt preferably comprises one or more of magnesium, zinc, calcium strontium or aluminium, more preferably magnesium, aluminium or zinc and most preferably magnesium. The metal salt may be any suitable salt that will react with a silicon-containing compound having a hydrolyzable substituent in a basic environment. Preferably the metal salt is a metal halide, such as a metal chloride. Most preferably, the metal salt is magnesium chloride, which may optionally be utilized as its hexahydrate form.

The silicon-containing compound should preferably have at least two hydrolyzable groups to facilitate formation of a metal organosilicate polymer and at least one non-hydrolyzable group to form an organic component of the organosilicate or facilitate the formation of the organic component of the organosilicate through subsequent functionalization.

The hydrolyzable (or leaving) group, may be any suitable organic substituent on the silicon-containing compound capable of being cleaved or hydrolyzed under suitable reaction conditions, such as hydrolysis conditions in a basic environment. For example, the hydrolyzable group may be a halo group, such as a chloro group, but is preferably an oxy derivative such as alkoxy, alkenyloxy, aryloxy, benzoyl and most preferably an alkoxy group.

The non-hydrolyzable group, may be any suitable organic substituent on the silicon-containing compound which does not cleave under conditions of cleavage or hydrolysis of the hydrolyzable or leaving group. The non-hydrolyzable group preferably forms the organo group of the resulting organosilicate polymer or organo group of the organosilicate polymer derived from the non-hydrolyzable group. For example, the non-hydrolyzable group may be further functionalized after the formation of the organosilicate, or may react under the conditions of the reaction to form a different organo group where, for example, the non-hydrolyzable group has a branch or substituent thereon which is hydrolyzable.

Typically, the non-hydrolyzable group is H or any suitable alkyl, alkenyl, aryl or benzyl group, each of which may substituted or unsubstituted.

In a preferred embodiment, the silicon-containing compound is a silicon alkoxide or a mixture of silicon alkoxides according to the formula $R'Si(OR)_3$, wherein R is an alkyl group comprising 1 to 5 carbon atoms and R' is a non-hydrolyzable group selected from H or an alkyl, alkenyl, aryl or benzyl group, each of which may be substituted or unsubstituted. Preferably, R' is a substituted or unsubstituted straight chain or branched alkyl or alkenyl group, more preferably a $C_1$-$C_{12}$ alkyl or alkenyl group, still more preferably a $C_2$-$C_8$ (e.g. in the range $C_3$-$C_5$) alkyl or alkenyl group and most preferably a methyl, ethyl, n-propyl, n-butyl or a vinyl group, each of which may be substituted or unsubstituted.

Substituent groups for the non-hydrolyzable group that may be optionally incorporated into the R' group, especially straight chain or branched alkyl or alkenyl groups, may be any suitable substituent for affecting the properties of the R' group as desired. For example, the substituent group may be a basic group, such as an amino group (including diamino or triamino substituents); a halogen, such as one or more fluoro, chloro, bromo or iodo, but preferably a chloro group; an ether or ester, an hydroxyl group, an acrylate, such as methacrylate, or other leaving group or hydrolyzable group that will enable further modifications, such as an epoxy group.

Most preferably R' is an alkyl, alkylacrylate, such as methacrylate, aminoalkyl, chloroalkyl or vinyl group, especially a methyl, ethyl, n-propyl, n-butyl, propyl methacrylate, 3-chloropropyl or 3-aminopropyl group.

The molar ratio of metal in the metal salt to silicon in the silicon containing compound of the reaction mixture forming the metal organosilicate polymer particulate material is in the range of from 3:2 to 1:2. preferably from 6:5 to 1:2.

The solvent medium in which the metal salt is contacted with the silicon-containing compound to form the metal organosilicate polymer particulate material may be any suitable reaction medium in which the reaction of the metal salt with the organosilicate to form the metal organosilicate polymer is facilitated. Preferably both the metal salt and the silicon-containing compound are at least partially soluble, more preferably substantially soluble, in the solvent medium and preferably the resultant metal organosilicate polymer particulate material is insoluble or substantially insoluble in the solvent medium.

The solvent medium is preferably an organic solvent medium, which comprises a suitable organic solvent and preferably consists essentially of one or more organic solvents. The organic solvent is preferably a polar solvent and may be, for example, ethyl acetate, dimethylsulfoxide, dimethylformamide or an alcohol. Preferably, the solvent is an alcohol, such as methanol or ethanol, more preferably ethanol. Optionally, the organic solvent medium contains a small amount of water, such as the water of crystallization of the metal salt or water absorbed from the atmosphere, to facilitate the hydrolysis of the hydrolyzable group(s). The amount of water present in the organic solvent medium may vary depending upon the nature of the silicon-containing compound and of the base used. Typically the molar ratio of water to organic solvent, such as ethanol, is preferably no more than 1:4, more preferably no more than 1:8 and most preferably no more than 1:10, i.e. most preferably the maximum amount of water (water/solvent ratio) is not greater than 0.1. At least a small amount of water in the solvent medium however is preferred to allow hydrolysis of the hydrolyzable group, e.g. a molar ratio of water to organic solvent, such as ethanol, of greater than 1:100, preferably greater than 1:50 and more preferably greater than 1:20, i.e. the minimum amount of water is most preferably at least 0.05. The amount of water present in the solvent medium, if any, may be associated with the amount of metal and as such the molar ratio of water to metal is preferably in the range of from 20:1 to 1:1, more preferably about 6:1.

The quantity of organic solvent used in the solvent medium depends upon the nature of the solvent used and the silicon-containing compound and metal salt. In the case of ethanol, it is preferable that the molar ratio of ethanol to metal salt is less than 500:1, more preferably less than 100:1 and most preferably less than 60:1. At least a molar ratio of ethanol to metal salt of 10:1 is desirable, preferably at least 25:1 and more preferably at least 50:1.

The base used in producing the metal organosilicate polymer particulate material used in the inkjet receiver of the invention may be a basic component forming part of the hydrolyzable group or of the non-hydrolyzable group of the silicon-containing compound, the base may be a supplemental base added to the reaction mixture, or the base present may be a mixture of one or more basic components and/or one or more supplemental bases. Suitable basic components may be, for example, amino substituents of the non-hydrolyzable group forming, for example, an amino or diaminoalkyl group. Suitable supplemental bases may be, for example, an organic supplemental base such as triethylamine or ethylenediamine or inorganic supplemental bases such as sodium hydroxide or potassium hydroxide, which are typically added as alcoholic solutions. Preferably, the supplemental base is sodium hydroxide.

Preferably, the molar ratio of total base to metal, wherein the total base includes supplemental base and/or basic group on the silicon-containing compound, is in the range of from 3:2 to 1:2.

Certain metal organosilicate polymer particulate materials, referred to as magnesium phyllosilicate clays or polysilsesquioxane salts, are described in Mann et al., "Hybrid lamella nanocomposites based on organically functionalized magnesium phyllosilicate clays with interlayer activity", Journal of Materials Chemistry, 1998, 8(8), 1927-32. Mann et al. describe the preparation by a direct synthetic procedure of layered magnesium phyllo (organo) silicate nanocomposites with covalently linked organic functionalities such as allyl, epoxy, imidazole and ethylendiamino groups. Certain properties of the resultant nanocomposite materials were demonstrated, including a good binding capacity for Co(II) of the ethylenediamine-functionalized magnesium phyllo (organo) silicate.

Further characterization of the proposed structure of such materials is described in Mann et al., the entire disclosure of which is incorporated herein by reference.

Preferably, the metal organosilicate polymer particulate material is obtainable using the method described in Mann et al., with optional substitution of the metal and of the silicon-containing compound described above.

Other descriptions of layered metal organosilicate polymers, as described in Fukishima et al., J. Chem Soc, Chem Commun, 1995, 241 (magnesium and nickel species described by the generic formula $(SiR)_8M_6O_{16}(OH)_4$ wherein M is Mg or Ni, and R is a common organic group found in silane coupling agent chemistry) and Ukrainczyk et al., J. Phys Chem B, 1997, 101, 531 (aluminum species of general formula $(RSi)_4Al_2O_8(OH)_2$, wherein R is dodecyl or octyl), are also incorporated herein by reference.

In one embodiment, wherein the metal organosilicate polymer particulates comprise mixed metal coordination structures, the metal organosilicate polymer particulate material may be defined as being obtainable by controlled co-hydrolysis methods, comprising treating with an alcoholic alkali solution a mixed metals salt (e.g. magnesium, zinc, calcium, strontium and/or aluminium) and silicon-containing compounds defined by the formula $R'_xSi(OR)_{4-x}$, wherein x is in the range 1 to 2, R' is H or an alkyl, alkenyl, aryl or benzyl group, each of which may be substituted or unsubstituted, and R is an alkyl group comprising 1 to 5 carbon atoms. Where the R' function of the silicon-containing compounds includes a basic group such as amino group, it is not necessary to add an alcoholic alkali solution. The metal to silicon molar ratio should preferably be maintained from 6:5 to 1:2 and the total base to metal molar ratio (including added base and/or basic group on the silicon-containing compound) maintained from 3:2 to 1:2. The product polymer particulate material may be obtained by filtrating the white precipitate formed and washing (e.g. with ethanol) to eliminate any by-products formed and then drying.

In a further embodiment of the invention, metal organosilicate polymer particles may be formed having mixed organo-groups. This may be achieved by contacting the one or more metal salts with at least two silicon-containing compounds (e.g. silanes), at least two of which have different non-hydrolyzable groups, such that an organosilicate with two or more different organic components may be formed. For example, a first silicon-containing compound having an aminopropyl group and a second silicon-containing compound having a vinyl group may be contacted according to the method described above with a magnesium chloride salt in the presence of a base to form magnesium organosilicate polymer particulates having aminopropyl groups and vinyl groups. The organo groups, optionally, may be further functionalized as desired.

Such materials may be said to be formed by controlled co-hydrolysis methods, comprising treating with an alcoholic alkali solution mixed metals salts (e.g. one or more salts of magnesium zinc, calcium, strontium and aluminium) and a mixture of silicon-containing compounds $R'^1_xSi(OR_1)_{4-x}$ and $R'^2_ySi(OR_2)_{4-y}$, wherein x and y are independently in the range 1 to 2, $R'^1$ and $R'^2$ are non-hydrolyzable groups selected independently from H or an alkyl, alkenyl, aryl or benzyl group, each of which may be substituted or unsubstituted, and $R_1$ and $R_2$ are each independently an alkyl group comprising 1 to 5 carbon atoms. For some embodiments wherein the R' functions of the silicon-containing compounds include a basic group, such as amino group, it is not necessary to add an alcoholic alkali solution, although a small amount of base may be necessary to ensure that the desired stoichiometric equivalent amount of base is present. The metal to silicon molar ratio is preferably maintained from 6:5 to 1:2 and the total base to metal molar ratio (including added base and/or basic group on the silicon-containing compound) maintained from 3:2 to 1:2. Preferably, an alcoholic solution of sodium, potassium or lithium hydroxide, diethylamine or triethylamine with a concentration between 0.5 M and 5 M, preferably about 3 M, is used. Moreover the alkoxy groups of silicon-containing compounds, namely $OR_1$ and $OR_2$ are preferably propoxy, ethoxy or methoxy groups.

In another aspect, described above, the inkjet receiver is characterized by the metal organosilicate polymer particulate material comprising particles having a first metal in coordination with an organosilicate, the first metal being selected from one or more of aluminium, magnesium, strontium, calcium and zinc, wherein the organosilicate comprises a silicon-containing compound having an organic substituent, and wherein the metal:silicon ratio is in the range of from 3:2 to 1:2.

Preferably, the organic substituent is selected from one or more substituted or unsubstituted straight chain or branched alkyl, straight chain or branched alkenyl, aryl or benzyl groups as hereinbefore defined for R'. Substituent groups for the organic substituent, especially straight chain or branched alkyl or alkenyl groups, may be any suitable substituent for affecting the properties as desired, as described hereinbefore for substituents on R'.

The metal of the metal organosilicate polymer particulate material preferably comprises magnesium or zinc and most preferably magnesium.

In a preferred embodiment, the metal organosilicate polymer particulate material may be defined in terms of having a metal, silicon, organic substituent arrangement according to the formula $M_mM'_n(SiR'^1)_p(SiR'^2)_q$, wherein M and M' are the same or different and selected from one or more of magnesium, zinc, calcium, strontium and aluminium, preferably, magnesium, zinc and strontium with most preferably at least one of M and M' being magnesium; $R'^1$ and $R'^2$ represent non-hydrolyzable organic substituents as defined above, which may be the same or different; and the ratio of (m+n)/(p+q) is in the range 1.5 to 0.5. When M and M' are the same, they are selected from aluminium, magnesium, zinc, calcium and strontium, especially when $R'^1$ and $R'^2$ are the same.

In one embodiment, M is the same as M' and is selected from magnesium, zinc, calcium, strontium and aluminium and $R'^1$ and $R'^2$ are different from one another. Preferably, the metal is magnesium. The $R'^1$ and $R'^2$ groups may be any suitable organic substituents as defined above. For example, $R'^1$ may be a methyl, ethyl, n-propyl, n-butyl, 3-chloropropyl or 3-aminopropyl group and $R'^2$ may be an alkylacrylate or vinyl group.

In another embodiment, M and M' are different and M is selected from magnesium, zinc, calcium, strontium and aluminium and is preferably magnesium, while M' is selected from magnesium, zinc, calcium, strontium and aluminium and is preferably aluminium. In this embodiment, $R'^1$ and $R'^2$ may be the same or different and can be as defined above.

Where M and M' are different, the molar ratio of M to M' may be any desired ratio, but is preferably in the range 2:8 to 8:2, more preferably in the range 4:6 to 6:4. Where M and M' are different and M is magnesium, the molar ratio is preferably in the range 4:6 to 9:1, preferably at least 6:4 in favour of magnesium.

Where $R'^1$ and $R'^2$ are different from one another, they may be selected according to desired properties of the resultant metal organosilicate polymer particulate material. For example, one may be selected to enhance the solubility of the particulate material in aqueous media, for example by inclusion of a water-solubilizing group, thus facilitating the coating of the material in an aqueous coating medium, whilst the other may be selected to perform a functional role in the inkjet receiver, such as enabling further functionalization, to bind to a mordant included in the layer, to bind to dye or pigment particles, to remove ozone from the atmosphere thus preventing its contact with the dye or pigment or to bind to a further functional additive.

Specific metal organosilicate polymer particulate materials falling within the scope of the invention include those having the general formulae (I) $(SiR')_8M_6O_{16}(OH)_4$ and (II) $(R'Si)_4Al_2O_8(OH)_2$, wherein R' is as defined above.

The one or more layers of the inkjet receiver of any aspect of the present invention may comprise one or a mixture of more than one metal organosilicate polymer particulate material, wherein a first metal organosilicate polymer particulate material and a second metal organosilicate polymer particulate material may differ in the identity of the metal or mixture of metal or the organo component of the organosilicate.

Where more than one layer of the inkjet receiver comprises a metal organosilicate polymer particulate material, the metal organosilicate polymer particulate material in one layer may be the same as or different from that in another layer. For example, a first layer may have a first metal organosilicate polymer particulate material and a second layer may have a second metal organosilicate polymer particulate material which differs from the first in the identity of the metal or mixture of metal or the organo component of the organosilicate, or the second layer may comprises a mixture of the first and second particulate materials.

Optionally, of the one or more coated layers of the inkjet receiver, at least one layer comprises a first metal organosilicate polymer particulate material as defined above and one or more further particulate materials, such as a clay, a colloidal silica, an alumina, a boehmite, an aluminosilicate polymer or a second metal organosilicate polymer particulate material different from the first metal organosilicate polymer particles.

Further inorganic particulate materials may be any suitable inorganic particulate capable of forming a porous receiving layer with the first metal organosilicate polymer particulate material and a suitable binder in the aforementioned relative amounts. Suitable such inorganic particulate materials may include, for example silica (e.g. colloidal silica), alumina (e.g. alumin sols, colloidal alumina, cationic aluminium oxide or hydrates thereof, pseudoboehmite, etc.), surface-treated cationic colloidal silica, magnesium silicate, aluminium silicate, calcium carbonate, magnesium carbonate, kaolin, talc, calcium sulfate, barium sulfate, titanium dioxide, zinc oxide, zinc sulfide, zinc carbonate, satin white, diatomaceous earth, calcium silicate, aluminium hydroxide, lithopone, zeolite(s) (such as molecular sieves 3A, 4A, 5A and 13X), hydrated hallocyte and magnesium hydroxide. Preferably, such a further inorganic particulate material is a colloidal silica or an alumina. Examples of suitable colloidal silicas include, for example, Nalco®1115 (4 nm), Ludox® SM-30 (7 nm), Ludox® LS-30 (12 μm), Ludox® TM-40 (22 nm), Ludox® AM (~30 nm), Ludox® TM-30 (~50 nm) and Ludox® PW-50 (~80 nm) or a mixture thereof, preferably Ludox® PW-50.

The alumina may be one or more forms of alumina, such as, for example, porous alumina, amorphous alumina, boehmite (such as a pseudo-boehmite modified with rare earths as described in U.S. Pat. No. 6,256,419, the disclosure of which is incorporated herein by reference, alumina hydrate particles, alumina hydrate surface-coated particles (e.g. alumina hydrate surface-coated silica particles) or fumed alumina. Specific examples of fumed alumina include those available from Cabot Corporation under the trade name CAB-O-SPERSE™ PG003 or PG008.

The binder is in an amount of from 0.5 to 25% by dry weight of the metal organosilicate polymer particulate material-containing layer, preferably from 2 to 20%, more preferably from 5 to 15%.

Optionally, the metal organosilicate polymer particulate material containing layer may comprise a mordant. The mordant may be any suitable mordant and may be any one or more of, for example, a cationic polymer, e.g. a polymeric quaternary ammonium compound, or a basic polymer, such as poly (dimethylaminoethyl)methacrylate, polyalkylenepolyamines, and products of the condensation thereof with dicyanodiamide, amine-epichlorohydrin polycondensates, divalent Group II metal ions, lecithin and phospholipid compounds, or any suitable mordant that is capable of assisting with fixing a dye material transferred to it. Examples of such mordants include vinylbenzyl trimethylammonium chloride/ethyleneglycol dimethacrylate, poly(diallyldimethyl ammonium chloride), poly(2-N,N,N-trimethylammonium)ethyl methacrylate methosulfate and poly(3-N,N,N-trimethylammonium)propyl chloride. A preferred mordant is a quaternary ammonium compound such as, for example, a polymer of (m- and p-chloromethyl)ethenylbenzene and 2-methyl-2-propenoic acid 1,2-ethanediylester, quaternized with N,N-dimethylmethanamine.

The layer may, optionally, further comprise an amorphous hydrated aluminosilicate for the reduction of smearing of an image, when a printed receiver is stored at high temperatures and humidities. Suitable such materials are described in WO 2004/039724 and WO 2004/009494, the disclosures of which are incorporated herein by reference.

The layer may also include a surfactant added, for example, to improve the coatability of the coating composition. Suitable surfactants, depending upon the coating method used, include fluorosurfactants such as Lodyne® S100 or Zonyl® FSN, or a non-fluoro surfactant such as Olin® 10G.

The ink-receiving layer preferably comprises from 5 to 95 wt % metal organosilicate polymer particulate material, compared with the total weight of the dry state ink-receiving layer.

The metal organosilicate polymer particulate material may typically be present in a layer of the inkjet receiver, preferably an ink-receiving layer, in an amount of from 10 to 40 $g/m^2$, preferably 15 to 25 $g/m^2$. Where other particulate materials are present, the metal organosilicate polymer particulate material preferably comprises at least 5% by weight of the particulate material and preferably in the range of from 5% to 15%, to ensure the beneficial properties are provided in an economic manner.

Where other particulate materials, such as colloidal or fumed silica, fumed alumina or a boehmite, are present in a layer with a metal organosilicate polymer particulate material as described above, the molar ratio of the metal of the metal organosilicate polymer particulate material to the other particulate material is preferably at least 2:98, preferably up to 95:5, more preferably in the range 5:95 to 50:50 or up to 25:75, still more preferably from 10:90 to 20:80, whilst maintaining the improved keeping properties of the metal organosilicate polymer particulate material in the inkjet receiver.

Optionally, the inkjet receiver comprises a subbing layer between the support and the ink-receiving pack. The subbing layer is preferably coated onto the support prior to coating the lowest layer of the ink-receiving pack, e.g. the subbing layer may be coated in a separate pass of a coating station to that of the ink-receiving pack. The subbing layer may be adjacent to the lowest layer of the ink-receiving pack or may be separated by one or more interlayers.

The subbing layer, which improves the adhesion of the underlayer of the ink-receiving pack to the support, typically comprises a polymer material, such as sulfonated polyesters, gelatin, poly(vinyl pyrrolidone), cellulose ethers and their derivatives such as methyl cellulose. Preferably the subbing layer comprises a boric acid, borate or derivative and/or salt thereof, such as sodium borates, derivatives of boric acid, boric anhydride and the like. A particularly preferred borate is sodium tetraborate decahydrate, which is available from Borax Limited under the trade name Borax® Decahydrate.

The total dry laydown of material in the subbing layer is preferably in the range 0.5 to 3 g/m$^2$, more preferably 1.5 to 2.5 g/m$^2$.

Optional additional components for inclusion in the subbing layer include surfactants for facilitating coating of the subbing layer onto the support.

An inkjet receiver of the present invention may be manufactured by coating the ink-receiving pack and any optional further layers, such as the subbing layer, onto the support by any suitable process known in the art. In order to improve the adhesion of the ink-receiving pack and optional further layers to the support, the surface of the support may optionally be subjected to a corona discharge treatment prior to applying the coatings.

The coating compositions, which may be aqueous- or solvent-based dispersions, but are preferably aqueous dispersions of the components for use in the desired layers, may be applied by any suitable technique, such as, for example, dip coating, wound-wire rod coating, doctor blade coating, rod coating, air knife coating, gravure and reverse-roll coating, slide coating, bead coating extrusion coating, curtain coating and the like. Preferably an extrusion coating or curtain coating technique is used and more preferably extrusion coating.

In the coating process, any optional subbing layer is preferably first coated onto the support and dried and then the layers of ink-receiving pack coated simultaneously or sequentially onto the optionally coated support. Where there are two layers in the ink-receiving pack, the two layers may be coated sequentially with drying of the second layer prior to coating the first layer or may be coated simultaneously. A third or subsequent layer of the ink-receiving pack may be coated prior to the upper layers or simultaneously with the second or second and first layers.

To produce the coating composition intended to be coated onto the support to constitute the ink-receiving layer of the inkjet receiver (or recording element) described above, the binder, which is preferably a hydro-soluble binder such as polyvinylalcohol, is diluted in the solvent (preferably water) to adjust its viscosity and facilitate its coating. The composition then has the form of an aqueous solution or a dispersion containing all the necessary components. When the metal organosilicate polymer as obtained above is used for preparing the composition as a powder, this powder is preferably a very fine powder.

The composition is preferably applied with a thickness of approx. 20 to 300 μm in the wet state, more preferably from 100 to 300 μm and most preferably about 200 μm. The composition forming the ink-receiving layer can be applied to both sides of the support. It is also possible to provide an antistatic or anti-winding layer on the back of the support coated with the ink-receiving layer.

The inkjet receiver or recording element according to the invention can comprise, besides the ink-receiving layer described above, other layers having another function arranged above or below the ink-receiving layer. The ink-receiving layer as well as the other layers can comprise any other additive known to those skilled in the art to improve the properties of the resulting image, such as UV ray absorbers, optical brightening agents, antioxidants, plasticizers, etc.

The ink-receiving layer useful in the present invention has a thickness generally from 1 μm to 50 μm in the dry state. The inkjet recording element comprising such an ink-receiving layer has improved dye-keeping properties in time, as well as an improved instant dryness. It can be used for any type of inkjet printer as well as for all the inks developed for this technology.

The invention will now be described in detail, without limitation as to the scope of the invention, according to the following examples.

EXAMPLES

Example 1-5

Preparation of Various Metal Organosilicate Polymers

Example 1

1.2 mol. $MgCl_2.6H_2O$ was solubilized in 2900 g ethanol and then 312 g (3-aminopropyl)triethoxysilane was quickly added. A white precipitate was formed and the mixture stirred at room temperature for 24 h. After filtration, the white precipitate was washed with 2000 g ethanol. The white powder was dried at room temperature for 2 days. The yield versus Mg was 93%. The molar ratio Mg/Si was 0.6, as measured by ICP-AES (Inductively Coupled Plasma Atomic Emission Spectrophotometry). The product was found to be poorly crystallized.

Example 2

1.2 mol $MgCl_2$, $6H_2O$ was solubilized in 2900 g ethanol and then 339 g (3-chloropropyl) triethoxysilane was quickly added. The mixture formed was colourless and transparent. 56 g of NaOH solubilized in 1000 g ethanol was then added. A white precipitate formed very quickly and the mixture was then stirred at room temperature for 24 h. After filtration, the white precipitate was washed with 2000 g ethanol and the white powder dried at room temperature for 2 days. The yield versus Mg was 92% and the molar ratio Mg/Si was 0.7, as measured by ICP-AES. A similar product was obtained when triethylamine was used instead of NaOH. The product was found to be poorly crystallized.

Example 3

0.6 mol $MgCl_2.6H_2O$ was solubilized in 1500 g of ethanol and then 193.5 g of n-octyltriethoxysilane was added. The mixture was colourless and transparent. 28 g of NaOH solubilized in 1000 g ethanol was then added. A white precipitate was formed very quickly and the mixture then stirred at room temperature for 24 h. After filtration the white precipitate was washed with 2000 g cold ethanol. The white powder was dried at room temperature for 2 days. The yield versus Mg was 70% and the molar ratio Mg/Si was 0.7, as measured by ICP-AES. A similar product was obtained when triethylamine was used instead of NaOH. The product was found to be poorly crystallized.

Example 4

0.6 mol $MgCl_2.6H_2O$ was solubilized in 1500 g ethanol and then 173.5 g 3-(trimethoxysilyl)propyl methacrylate added. The mixture was colourless and transparent. 28 g of NaOH solubilized in 1000 g ethanol was then added. A white precipitate was formed very quickly and the mixture stirred at room temperature for 24 h. After filtration, the white precipitate was washed with 2000 g cold ethanol. The white powder was dried at room temperature for 2 days. The yield versus Mg was 65% and the molar ratio Mg/Si was 0.85, as measured by ICP-AES. A similar product was obtained when triethylamine was used instead of NaOH. The product was found to be poorly crystallized.

Example 5

100 g of $MgCl_2.6H_2O$ was solubilized in 1200 g ethanol, then a mixture of 116.6 g of (3-aminopropyl)triethoxysilane, 25 g vinyltriethoxysilane and 12 g triethylamine in 200 g ethanol was quickly added. A white precipitate was quickly formed. The mixture was stirred at room temperature for 24 h. After filtration, the white precipitate was washed with 1000 g ethanol. The white powder was dried at room temperature for 2 days. The yield versus Mg was 87% and the molar ratio Mg/Si was 1.18, as measured by ICP-AES. The infrared spectrum confirmed the presence of the two organic moieties. The product was found to be poorly crystallized.

Comparative Example 1

1.2 mol $MgCl_2.6H_2O$ was solubilized in 2900 g ethanol and then 353.6 g tetraethoxysilane quickly added. The mixture was colorless and transparent. 56 g NaOH solubilized in 1000 g ethanol was added. A white precipitate was formed and the mixture stirred at room temperature for 24 h. After filtration the white precipitate was washed with 2000 g ethanol. The white powder was dried at room temperature for 2 days. The yield versus Mg was 100%. The molar ratio Mg/Si was 0.5 measured by ICP-AES. The product was found to be well crystallized and X-Ray data indicated that it was unambiguously pure talc.

Examples 6-8

Preparation of Metal Organosilicate Polymer and Inorganic Particulate Mixtures

Example 6

Mixture of Colloidal Silica and Metal Organosilicate Polymer 120 g metal organosilicate polymer particulate described in Example 1 was mixed with 1200 g colloidal silica Nalco 2329 (40% in weight of silica in water). The mixture was dialfiltrated to remove all the NaCl coming from Nalco product and the concentration was adjusted by an Ultrafiltration membrane, AMICON S10Y10 (10KD) at 1.5 Bar. The final stable colloidal suspension was analyzed by ICP-AES and exhibited a molar ratio of metal organosilicate polymer to $SiO_2$ of 13/87.

Example 7

Mixture of Fumed Silica and Metal Organosilicate Polymer 120 g metal organosilicate polymer particulate described in Example 1 was solubilized in 2000 g osmosed water, then 480 g fumed silica (Aldrich, S5505) was added. The white mixture was dialfiltrated to remove by-products and the concentration adjusted by an Ultrafiltration membrane AMICON S10Y10 (10 KD) at 1.5 Bar. The final stable colloidal suspension was analyzed by ICP-AES and exhibited a molar ratio of metal organosilicate polymer to $SiO_2$ of 12/88.

Example 8

Mixture of Boehmite and Metal Organosilicate Polymer 3.3 g metal organosilicate polymer particulate described in Example 1 was solubilized in water forming a 16.66% by weight solution of metal organosilicate polymer. This metal organosilicate polymer solution was mixed with various amount of the boehmite Sasol Catapal™ 200, in order to design a mixture with a molar ratio of metal organosilicate polymer to aluminium of 12/88.

Examples 9

Preparation of Coating Compositions Constituting an Ink-receiving Layer Coated on a Support As hydro-soluble binder, polyvinyl alcohol was used with molecular weight >100,000 and hydrolysis rate of 86% (Gohsenol™ GH23 marketed by Nippon Gohsei), diluted to 9% by weight in osmosed water. Four types of coating composition, A, B, C and D were prepared. Compositions A included the metal organosilicate polymer particulates prepared according to the syntheses described in Examples 1 to 5. Compositions B included the talc prepared according to the synthesis described in Comparative Example 1. Compositions C included a mixture of metal organosilicate polymer particulates and other particulates according to the syntheses described in Examples 6 to 8. Compositions D included a pure colloidal silica Nalco 2329.

All the coating compositions A were obtained by mixing:

10.1 g osmosed water 2 g metal organosilicate polymer particulate (dry matter)

2.7 g polyvinyl alcohol at 9% (PVA/metal organosilicate polymer weight ratio=0.12)

The metal organosilicate polymer particulates were in powder form, having first been finely crushed. The mixture was homogenized by shearing overnight.

Coating composition B was obtained by mixing:

10.1 g of osmosed water 2 g of talc prepared as described in comparative Example 1 (dry matter)

2.7 g polyvinyl alcohol at 9% (PVA/talc weight ratio=0.12)

The talc was in powder form, the particles having first been finely crushed. The mixture was homogenized by shearing overnight.

All the coating compositions C were obtained by mixing:

10.1 g osmosed water 2 g mixture metal organosilicate polymer particulates/other particulates (dry matter)

an amount of polyvinyl alcohol at 9% in order to keep a (PVA/inorganic mixture) weight ratio equal to 0.12 compositions C could be coated as soon as the mixtures were prepared.

Coating composition D was obtained by mixing:

10.1 g osmosed water 2 g of colloidal silica Nalco 2329 (dry matter)

an amount of polyvinyl alcohol at 9% in order to keep a (PVA/inorganic charge) weight ratio equal to 0.12.

Example 10

Preparation of Inkjet Recording Elements

A resin-coated paper-type support was placed on a coating machine, first coated with a very thin gelatin layer and held on the coating machine by vacuum. The support was coated with a composition as prepared according to Example 9 using a blade. The wet thickness was 125 μm for Examples 1-5 and 200 μm for Comparative Examples 1 and 2 and Examples 6-8. Then, it was left to dry for 3 h at ambient temperature (21° C.).

The resulting inkjet receivers corresponding to the examples are given in TABLE 1 below, specifying the material used in the ink-receiving layer.

TABLE 1

| Recording element | Composition | Material in the ink-receiving layer |
|---|---|---|
| Ex. 1 (inv.) | A | Metal organosilicate polymer-synthesis No. 1 |
| Ex. 2 (inv.) | A | Metal organosilicate polymer-synthesis No. 2 |
| Ex. 3 (inv.) | A | Metal organosilicate polymer-synthesis No. 3 |
| Ex. 4 (inv.) | A | Metal organosilicate polymer-synthesis No. 4 |
| Ex. 5 (inv.) | A | Metal organosilicate polymer-synthesis No. 5 |
| Comp. Ex. 1 (comp) | B | Talc prepared as per synthesis comparative No. 1 |
| Ex. 6 (inv.) | C | Mixture of metal organosilicate polymer synthesis No. 1 and colloidal silica Nalco-synthesis No. 6 |
| Ex 7 (inv.) | C | Mixture metal organosilicate polymer-synthesis No. 1 and fumed silica Aldrich-synthesis No. 7 |
| Ex 8(inv.) | C | Mixture metal organosilicate polymer-synthesis No. 1 and boehmite Sasol-synthesis No. 8 |
| Comp Ex. 2 (comp) | D | Colloidal silica Nalco 2329 |

Example 11

Evaluation of Dye-keeping Properties Over Time

To evaluate the dye-keeping properties over time, a dye-fading test by exposure to ozone was performed for each resulting inkjet receiver. Targets comprising four colours (black, yellow, cyan and magenta) were printed onto each recording element using a KODAK™ PPM 200 or an Epson™ 690 printer and related ink. The targets were analyzed using a GretagMacbeth™ Spectrolino spectrophotometer that measured the intensity of the various colours. Then the recording elements were placed in the dark in a room with a controlled ozone atmosphere (60 ppb) for 3 weeks. Each week any degradation of the colour density was monitored using the spectrophotometer. If the density losses were less than 30% after 3 weeks, for all the colours, it was considered that the recording element enabled particularly stable printing to be obtained. The results are set out in TABLE 2 below.

TABLE 2

| Recording element | % density loss using a Kodak ™ PPM200 printer | % density loss using a Epson ™ 680 printer |
|---|---|---|
| Ex 1(inv) | <5% | <5% |
| Ex 2 (inv) | <7% | <5% |
| Ex 3 (inv) | <11% | <5% |
| Ex 4 (inv) | <6% | <5% |
| Ex 5 (inv) | <7% | <5% |
| Comp. Ex. 1 (comp) | >70% | >50% |

TABLE 2-continued

| Recording element | % density loss using a Kodak ™ PPM200 printer | % density loss using a Epson ™ 680 printer |
|---|---|---|
| Ex 6 (inv) | <8% | <5% |
| Ex 7 (inv) | <7% | <5% |
| Ex 8 (inv) | <7% | <5% |
| Comp. Ex. 2 (comp) | >70% | >70% |

TABLE 2 represents the % density loss for the four colours of the target after 3 weeks, printed using the Kodak™ PPM 200 printer and printed using the Epson™ 680. The % density loss was observed for the original density of 1.00 and the figure presented represents the density loss for the worst of the four colours in each case.

The metal organosilicate polymer particulate material for use in the invention provided improved resistance to density loss from ozone exposure in an inkjet receiver, compared to a receiver comprising talc (Comparative Example 1) or pure colloidal silica (Comparative Example 2).

The invention has been described with reference to a preferred embodiment. However, it will be appreciated that variations and modifications can be effected by a person of ordinary skill in the art without departing from the scope of the invention.

The patents and publications referred to herein are incorporated by reference in their entirety.

The invention claimed is:

1. An inkjet receiver comprising a support and one or more layers coated thereon, at least one layer of which comprises one or more metal organosilicate polymer particulate material(s) and a binder, the metal organosilicate polymer particulate material being obtainable by contacting a metal salt with a silicon-containing compound in an organic solvent, wherein either the silicon-containing compound contains a basic group and/or the reaction is conducted in the presence of a base, wherein the metal of said metal salt is selected from one or more of magnesium, strontium, calcium or zinc and the silicon-containing compound comprises hydrolyzable and non-hydrolyzable substituents; and collecting the metal organosilicate polymer particulate material.

2. An inkjet receiver as claimed in claim 1, wherein the silicon-containing compound is a silicon alkoxide.

3. An inkjet receiver as claimed in claim 1, wherein the metal is magnesium.

4. An inkjet receiver as claimed in claim 1, wherein one or more silicon-containing compounds has the formula $R'Si(OR)_3$, wherein R' is a non-hydrolyzable group selected from H or a substituted or unsubstituted alkyl, alkenyl, aryl or benzyl group and R is a hydrolyzable alkyl group having 1 to 5 carbon atoms.

5. An inkjet receiver as claimed in claim 1, wherein the organic solvent comprises at least one alcohol and is selected or used in an amount such that the metal organosilicate polymer is substantially insoluble.

6. An inkjet receiver as claimed in, claim 1, wherein the molar ratio of metal to silicon is in the range from 3:2 to 1:2.

7. An inkjet receiver as claimed in, claim 1, wherein the molar ratio of total base to metal, including added base and/or basic group on the silicon-containing compound, is from 3:2 to 1:2.

8. An inkjet receiver comprising a support and one or more layers coated thereon, at least one layer of which comprises one or more metal organosilicate polymer particulate material(s) and a binder, the metal organosilicate polymer particulate material comprising particles having a first metal in coordination with an organosilicate, wherein the-first metal is selected from one or more of magnesium, strontium, calcium and zinc, the-organosilicate comprises a silicon-containing compound having an organic substituent and the molar metal: silicon ratio is in the range of from 3:2 to 1:2.

9. An inkjet receiver as claimed in claim 8, wherein the organic substituent is selected from H and one or more substituted or unsubstituted alkyl, alkenyl, aryl or benzyl groups.

10. An inkjet receiver as claimed in claim 8, wherein the first metal is magnesium.

11. An inkjet receiver as claimed in claim 8, wherein the metal organosilicate polymer further comprises a second metal in coordination with the organosilicate, the second metal being different from the first metal and being selected from aluminium, magnesium, strontium, calcium and zinc.

12. An inkjet receiver as claimed in claim 1 comprising a support and one or more layers coated thereon, at least one layer of which comprises a first metal organosilicate polymer particulate material wherein the metal is selected from magnesium, strontium, calcium or zinc and one or more of a clay, a colloidal silica, a boehmite, an aluminosilicate polymer or a second metal organosilicate polymer particulate material different from the first metal organosilicate polymer particles.

13. An inkjet receiver as claimed in claim 12, wherein the molar ratio of metal organosilicate polymer particulate material to other particulate material in the layer is from 5:95 to 95:5.

14. An inkjet receiver as claimed in claim 8, wherein the metal organosilicate polymer particulate material has a metal, silicon, organic substituent arrangement according to the formula $M_mM'_n(SiR'^1)_p(SiR'^2)_q$, wherein M and M' are the same or different and selected from one or more of magnesium, zinc, calcium, strontium and aluminium; $R'^1$ and $R'^2$ are the same or different and represent organic substituents selected from H or substituted or unsubstituted alkyl, alkenyl, aryl or benzyl groups and the ratio of (m+n)/(p+q) is in the range 1.5 to 0.5, and wherein at least one of M and M' is selected from *magnesium*, *zinc*, *calcium*, and *strontium*.

15. A method of printing comprising the steps of providing an inkjet printer capable of responding to digital data signals;

providing the printer with ink;

providing the printer with an inkjet receiver comprising a support and one or more layers coated thereon, at least one layer of which comprises one or more metal organosilicate polymer particulate material(s) and a binder, said metal organosilicate polymer particulate material being obtainable by contacting a metal salt with a silicon-containing compound in an organic solvent, wherein either said silicon-containing compound contains a basic group and/or the reaction is conducted in the presence of a base, wherein the metal of said metal salt is selected from one or more of magnesium, strontium, calcium or zinc and said silicon-containing compound comprises hydrolyzable and non-hydrolyzable substituents; and collecting the said metal organosilicate polymer particulate material; and causing a set of digital data signals corresponding to a desired printed image to be sent to the printer.

16. An inkjet receiver as claimed in claim 8 comprising a support and one or more layers coated thereon, at least one layer of which comprises a first metal organosilicate polymer particulate material wherein the metal is selected from magnesium, strontium, calcium or zinc, and one or more of a clay, a colloidal silica, a boehmite, an aluminosilicate polymer or a second metal organosilicate polymer particulate material different from said first metal organosilicate polymer particles.

17. An inkjet receiver as claimed in claim 1, wherein the metal is magnesium, zinc, or strontium.

18. An inkjet receiver as claimed in claim 8, wherein the first metal is magnesium, zinc, or strontium.

19. An inkjet receiver as claimed in claim 14, wherein at least one of M and M' is magnesium, zinc, or strontium.

20. A method as claimed in claim 15, wherein the metal is magnesium, zinc, or strontium.

* * * * *